United States Patent [19]

Winkley

[11] 4,269,792

[45] May 26, 1981

[54] TAMPER RESISTANT CHOKE OPENING MEANS

[75] Inventor: Jerry H. Winkley, St. Louis, Mo.

[73] Assignee: ACF Industries Incorporated, New York, N.Y.

[21] Appl. No.: 120,973

[22] Filed: Feb. 13, 1980

[51] Int. Cl.[3] ..... F02M 1/08

[52] U.S. Cl. ..... 261/39 B; 137/382

[58] Field of Search ..... 261/39 B; 137/382

[56] References Cited

U.S. PATENT DOCUMENTS

| | | | |
|---|---|---|---|
| 3,167,254 | 1/1965 | Goodyear | 261/39 B |
| 3,227,428 | 1/1966 | Charron | 261/39 B |
| 3,544,085 | 12/1970 | Bier | 261/39 B |
| 4,152,377 | 5/1979 | Takata | 261/39 B |

*Primary Examiner*—Tim R. Miles

*Attorney, Agent, or Firm*—J. Joseph Muller

[57] ABSTRACT

A carburetor for an internal combustion engine has a choke valve mounted in an air induction passage. A choke lever is attached to one end of a choke shaft on which the choke valve is mounted. An improvement comprises a tamper resistant temperature responsive mechanism for controlling opening of the choke valve as the engine warms up. The mechanism includes a housing, a choke countershaft, one end of which extends into the housing, and a cover attachable to the housing and containing a thermostatic coil. A lever is attached to the one end of the counter shaft and the lever has a tang contacted by one end of the thermostatic coil. A substantially straight, nondeformable link connects the choke countershaft and choke lever. The lever within the choke housing is adjustable to position the lever so opening of the choke valve is properly controlled and tne setting of the lever cannot be tampered with once the cover is attached to the choke housing.

11 Claims, 8 Drawing Figures

FIG. 1
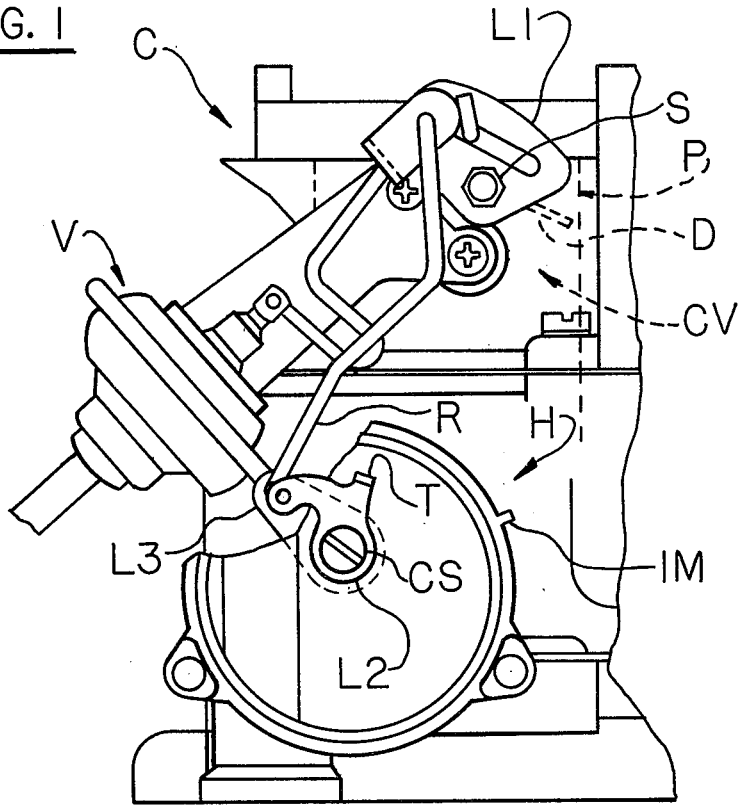
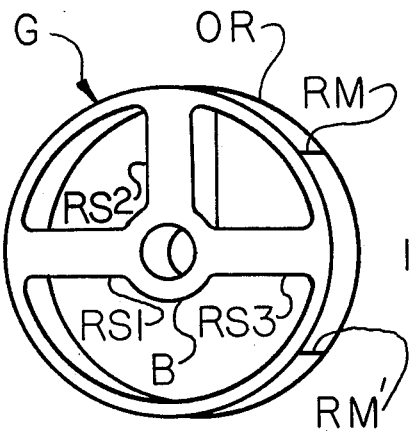
FIG. 2
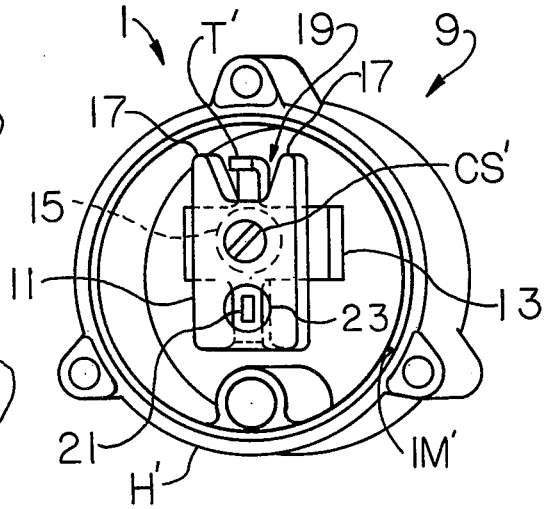
FIG. 3

TAMPER RESISTANT CHOKE OPENING MEANS

BACKGROUND OF THE INVENTION

This invention relates to carburetors and, more specifically, to a carburetor improvement by which the mechanism controlling opening of the carburetor choke valve is made tamper resistant.

An important area in controlling automobile engine exhaust emissions is calibrating various components of a carburetor installed on the engine so in their normal course of operation the air-fuel ratio of the mixture produced by the carburetor and supplied the engine is maintained within certain specified limits. In this regard, control of a carburetor's choke valve opening is especially important because of the high level of emissions which are produced during engine starting and warm up.

Choke valve operation on a carburetor involves two stages. The first stage occurs when the engine is started and the choke valve is pulled from its closed or substantially closed position to a first open position. The second stage involves the gradual movement of the choke valve from its first open to its fully open position as the engine warms up. Conventionally, the mechanism employed during the second stage involves a thermostatic coil acting on a lever which, in turn, controls rotation of a shaft on which the choke valve is mounted. On some carburetors, this lever does not act directly on the choke shaft, but rather is connected, via a rod or link, to a second lever which is attached to the choke shaft. During qualification of a carburetor of this type, a gage is used to set the lever and the rod or link is bent to adjust the position of the lever relative to the coil. When the proper relationship is established, the controlled opening of the choke valve is such as to produce an air-fuel mixture which is not excessively rich so engine emissions remain within specified tolerances.

A disadvantage of the above-described procedure is that the rod or link remains accessible after the carburetor is installed on an engine. Thus, someone can bend the rod or link so as to change the adjustment of the lever with the result that during choke valve opening an excessively rich air-fuel mixture is produced which, in turn, causes excessive engine emissions.

SUMMARY OF THE INVENTION

Among the several objects of the present invention may be noted the provision of an improvement in a carburetor by which the mechanism controlling the opening of a choke valve of the carburetor is made tamper resistant; the provision of such an improvement by which the mechanism is rendered unadjustable after a carburetor is completed and installed on a vehicle; the provision of such an improvement which is readily installed on a carburetor during manufacture; the provisions of such an improvement which is easily adjusted after installation to insure proper choke valve opening; and the provision of such an improvement by which no visible references are discernible on the carburetor, after its manufacture, by which one could make an adjustment.

Briefly, the improvement of the present invention comprises tamper resistant temperature responsive means for controlling the opening of a carburetor choke valve as the engine on which the carburetor is installed warms up. The means includes a housing, a choke counter shaft, one end of which extends into the housing, and a cover attachable to the housing and containing a thermostatic coil. A lever is attached to the one end of the counter shaft and the lever has a tang contacted by one end of the thermostatic coil thereby for the coil to exert a choke valve closing force on the lever, the force lessening as the engine heats up. A substantially straight, nondeformable link connects the choke countershaft with a choke lever. The lever within the choke housing is adjustable by a suitable adjusting tool to position the lever so opening of the choke valve is properly controlled thereby to aid in controlling engine emissions and whereby the setting of the lever cannot be tampered with once the cover is attached to the choke housing. Other objects and features will be in part apparent and in part pointed out hereinafter.

BRIEF DESCRIPTION OF THE DRAWINGS

FIG. 1 is a side elevational view of a carburetor illustrating a conventional mechanism for controlling the opening of a carburetor choke valve;

FIG. 2 is an isometric view of a gage used to adjust choke valve closing;

FIG. 3 is an isometric view of a first embodiment of a lever of the improvement of the present invention;

Corresponding reference characters indicate corresponding parts throughout the several views of the drawings.

DESCRIPTION OF PREFERRED EMBODIMENTS

Figure 6:
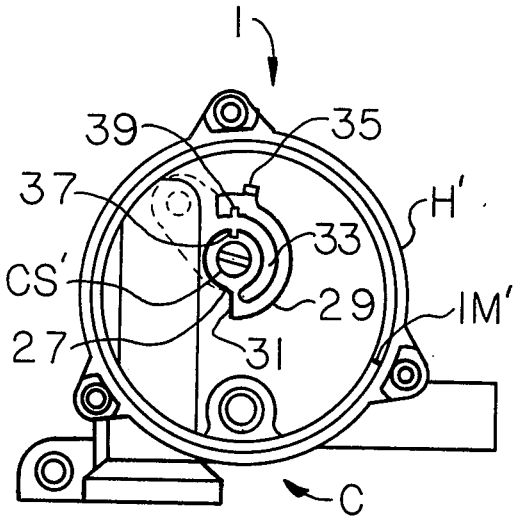
FIGS. 6 and 7 are front plan and side elevational views respectively of a second embodiment of a lever of the improvement of the present invention.

Referring to the drawings, a carburetor C for an internal combustion engine (not shown) has an air induction passage P. A choke valve CV is mounted in the passage and includes a disk D mounted on a rotatable choke shaft S. A choke lever L1 is attached to one end of choke shaft S.

As is well understood in the art, choke valve operation comprises two steps. Assuming the choke valve is closed, the first step involves moving the choke valve from its closed to an initial open position when the engine on which carburetor C is installed is started. A vacuum unit V acts on choke lever L1 to effect this initial opening. The vacuum unit responds to the vacuum created in the engine on starting to exert a force on choke lever L1 which, in turn, produces rotation of the choke shaft and opening movement of the choke valve. Operation of a vacuum unit V such as shown in FIG. 1 is well understood in the art and is not described in detail.

The second step involved requires a controlled movement of the choke valve from its initial open position to its fully open position as the engine warms up. Conventionally, and as shown in FIG. 1, a lever L2 is installed in a housing H. A cover (not shown) attaches to the housing and includes a thermostatic coil (also not shown). Lever L2 has a tang T against which one end of the thermostatic coil bears. The thermostatic coil exerts a choke valve closing force on lever L2 and this force is transmitted to the choke valve via a link or rod R. One end of link R is attached to lever L1 and the other end of the link is secured to a lever L3. Lever L3 is secured, in turn, to a choke counter shaft CS on which lever L2 is mounted. The thermostatic coil is subjected to engine heat and, as a result, the choke valve closing force exerted on lever L2 by the coil gradually lessens. This produces a gradual opening of the choke valve. Again, this operation is well known in the art.

It is important to properly calibrate the above-described mechanism so the air-fuel ratio of the mixture produced by carburetor C during choke valve opening does not result in excessive engine emissions. Thus, choke valve CV opening is so controlled that the air-fuel mixture produced by carburetor C is not overly rich. A gage G, see FIG. 2, is used for calibration. The gage has an outer rim OR and three radial spokes (RS1, RS2 and RS3 respectively) extending outwardly from a central hub B to the rim. Gage G is designed to fit on the front face of housing H when, as shown in FIG. 1, the cover is not installed on the housing. Hub B has a central opening which is aligned which the outer end of counter shaft CS. The gage is then rotated until the right side of spoke RS2 (as viewed in FIG. 2) engages the left side of tang T on lever L2 (as viewed in FIG. 1). The gage is rotated clockwise (as viewed in FIGS. 1 and 2) until lever L2 stops. This indicates choke valve CV has fully closed. Housing H has a raised index mark IM on its lower right side and gage G has a reference mark RM on its upper right side. When lever L2 stops moving, these two marks should align. If they do not, link R is bent (as shown in FIG. 1) with a suitable tool until the two marks do align when the choke valve is closed with rotation of lever L2 by gage G.

Because link R is deformable, the above-described calibration can be invalidated once carburetor C is in private hands. By tampering with the link, the air-fuel mixture is made richer than would occur if the factory calibration were left alone. As a consequence, engine exhaust emissions are higher than they are if the factory calibration is not tampered with.

Figure 5:
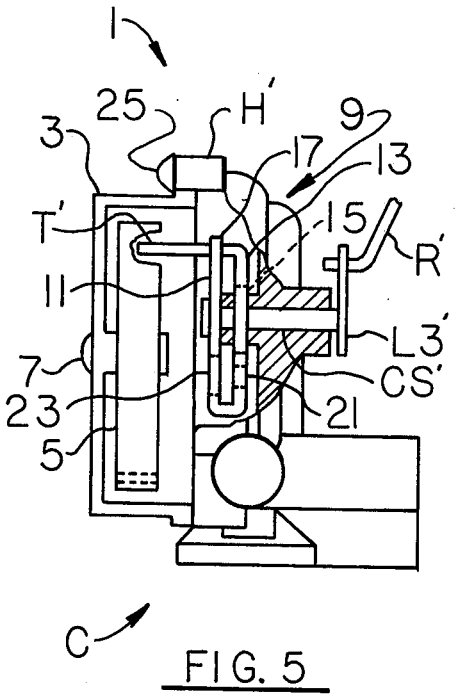
FIG. 5 is a side elevational view, in section, of the improvement of the present invention.
Figure 8:
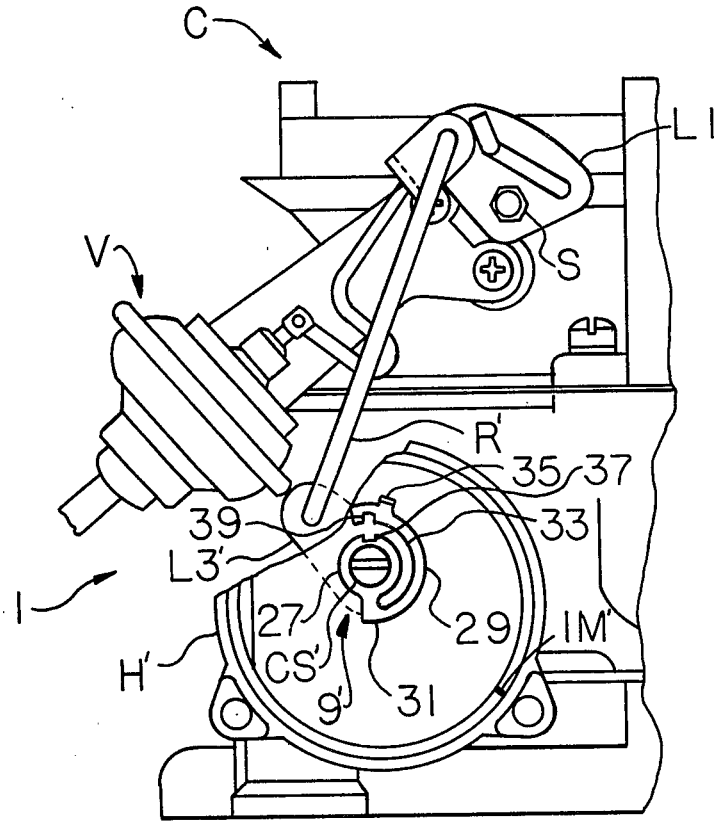
FIG. 8 is a side elevational view of a carburetor illustrating the mechanism for controlling opening of the carburetor choke valve using the second embodiment of the lever of the present invention.

The improvement of the present invention comprises a tamper resistant temperature responsive means 1 for controlling further opening of choke valve CV as the engine warms up. Referring to FIGS. 5 and 8, means 1 includes a housing housing H' and a choke countershaft CS' one end of which extends into the housing. A cover 3 is attachable to housing H' and contains a thermostatic coil 5 attached to the inner front face of the cover by a pin 7.

Figure 4:
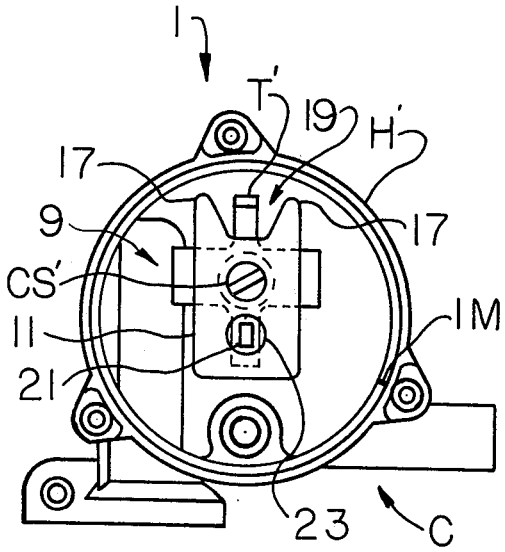
FIG. 4 is a front plan view of the lever and housing.

A lever 9 (see FIGS. 3–5) is attached to the one end of choke countershaft CS'. Lever 9 has a first section 11 securable to the outer end of choke countershaft CS' and a second second section 13 folded over behind the first section. As shown in FIG. 3, section 13 of lever 9 has a circular opening 15 larger than the diameter of the choke countershaft thus for section 13 of the lever to fit over the choke countershaft. The upper portion of section 11 of lever 9 has two upwardly projecting ears 17 and a notch 19 is formed between the ears. The upper portion of section 13 of lever 9 is forwardly bendable to form a tang T' contacted by thermostatic coil 5. As shown in FIGS. 3 and 4, the tang projects forwardly through the notch formed by ears 17. The lower portion of section 13 of lever 9 has a vertical slot 21 and the lower portion of section 11 has an opening 23 therein, this latter opening being somewhat larger in size that slot 21 and in registry therewith.

A substantially straight nondeformable rod or link R' is preferrably formed of a hardened metal. One end of link R' is attached to choke lever L1 and the other end of the link is attached to a lever L3' which is secured to choke countershaft CS'.

Because link R' cannot be bent, calibration of means 1 to achieve a proper air-fuel mixture ratio during choke valve opening cannot be performed by bending the rod or link as is done with conventional choke valve opening mechanisms. As before, a gage G is placed over housing H' when cover C is removed and the right edge of spoke RS2 is brought to bear against the left side of tang T'. The gate is turned counter-clockwise until lever 9 stops. An index mark IM' is inscribed on the front face of housing H' and a reference mark RM' is located on lower right side of the outer rim of the gage. For proper calibration, these marks should align when lever 9 is at its extreme clockwise position. If the marks do not align, a suitable adjusting tool such as a screwdriver is inserted into vertical slot 21 through opening 23. Twisting the screw driver in the appropriate direction twists section 13 of lever 9 and moves tang T' in notch 19 toward one ear 17 or the other. The adjustment of the position of tang T' in the notch accomplishes the same thing as the bending of link R in conventional choke valve opening mechanisms. That is, the position of lever 9 is so adjusted that proper control over choke valve CV opening is obtained while the air-fuel ratio of the mixture produced during choke valve opening does not result in excessive engine emissions.

After the calibration is completed, cover 3 is attached to housing H' by rivets 25. Now, the calibration cannot be readily tampered with because link R' cannot be bent to change the lever 9 position. Further, cover 3 cannot be easily removed to provide access to the lever. Finally, installation of cover 3 hides index mark IM' and consequently, there is no visible mark to aid someone wishing to change the calibration.

It will be understood that lever 9 is of single-piece construction and is readily formed into the shape shown in FIGS. 3–5 prior to installation on a carburetor. Further, the lever is readily installed on the carburetor during its manufacture and the calibration is easily performed as a step during carburetor assembly.

Figure 7:
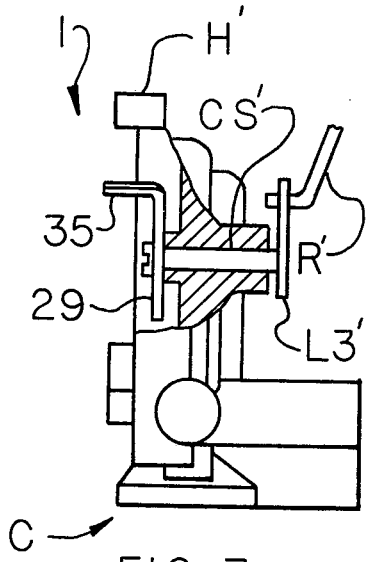

Referring to FIGS. 6–8, a lever 9' comprising a second embodiment of a portion of means 1 is shown. Lever 9' includes a first section 27 of generally circular shape with a central opening for securing the lever to the one end of choke countershaft CS'. The lever also has a second and substantially semicircular section 29 which is displaced radially outwardly from section 27. The lower portions of the two sections are joined as indicated at 31 and a slot 33 is formed between the sections along their common arc. The upper portion of section 29 has an outwardly extending arm 35 forming a tang contacted by thermostatic coil 5. The upper portion of section 27 has an inwardly extending notch 37 and the inner face of section 29 has a corresponding inwardly extending notch 39. The center of these notches lie on the same radial line. With gage G being used as before-described, reference mark RM' on the gage should align with an index mark IM' on the front face of housing H'. If the marks do not align, an adjustment tool, such as a screwdriver, is simultaneously inserted in notches 37 and 39 and twisted in the appropriate direction. If turned clockwise, lever section 29 is forced away from section 27 to move tang 35 clockwise. If the screwdriver is turned counterclockwise, lever section 29 is drawn in toward section 27 to move the tang counterclockwise. In either event, the lever is adjustable to obtain proper operation of the choke opening mechanism.

It will be understood that lever 9' is of simpler construction than lever 9 while still having the same advantages. As before, use of lever 9' together with link R' makes the choke opening mechanism tamper resistant since the link is nondeformable.

In view of the above, it will be seen that the several objects of the invention are achieved and other advantageous results obtained.

As various changes could be made in the above constructions without departing from the scope of the invention, it is intended that all matter contained in the above description and shown in the accompanying drawings shall be interpreted as illustrative and not in a limiting sense.

What is claimed is:

1. In a carburetor for an internal combustion engine, the carburetor having an air induction passage, a choke valve mounted in the passage and including a disk mounted on a rotatable choke shaft, a choke lever attached to one end of the choke shaft, a vacuum unit acting on the choke lever to effect an initial opening of the choke valve when the engine is started, the improvement comprising tamper resistant temperature responsive means for controlling further opening of the choke valve as the engine warms up, the means including a housing, a choke countershaft one end of which extends into the housing, a cover attachable to the housing and containing a thermostatic coil, a lever attached to the one end of the counter shaft and having a tang contacted by one end of the thermostatic coil thereby for the coil to exert a choke valve closing force on the lever, the force lessening as the engine heats up, and a substantially straight, nondeformable link connecting the choke countershaft and the choke lever, the lever within the choke housing being adjustable by a suitable adjusting tool to position the lever so opening of the choke valve is properly controlled thereby to aid in controlling engine emissions and whereby the setting of the lever cannot be tampered with once the cover is attached to the choke housing.

2. The improvement as set forth in claim 1 wherein the lever has a first section secureable to the end of the choke countershaft projecting into the housing and a second section folded over behind the first section, the second section of the lever having an opening therein larger than the diameter of the choke countershaft for the second section of the lever to fit over the choke countershaft.

3. The improvement as set forth in claim 2 wherein the upper portion of the first section of the lever has two upwardly projecting ears forming a notch therebetween and the upper portion of the second section of the lever is forwardly bendable to form the tang contacted by the thermostatic coil, the tang projecting forwardly through the notch formed by the ears.

4. The improvement as set forth in claim 3 wherein the lower portion of the second section of the lever has a vertical slot and the lower portion of the first section of the lever has an opening therein in registry with the slot, an adjusting tool such as a screwdriver or the like being insertable in the slot to move the tang relative to the ears and thereby adjust the lever to obtain proper control over opening of the choke valve.

5. The improvement as set forth in claim 1 wherein the lever comprises a first section securable to the end of the choke countershaft projecting into the housing and a second and substantially semicircular section displaced radially outwardly from the first section.

6. The improvement as set forth in claim 5 wherein the first and second sections of the lever are connected at the lower portions thereof and a slot is formed between the sections substantially along their common arc.

7. The improvement as set forth in claim 6 wherein the upper portion of the second section of the lever has a forwardly extending arm forming the tang contacted by the thermostatic coil.

8. The improvement as set forth in claim 7 wherein the upper portion of the first section of the lever has an inwardly extending notch and the inner face of the second portion of the lever has a corresponding inwardly extending notch, the center of the notches lying substantially on the same radial line, and an adjustment tool such as a screwdriver or the like being insertable into both notches simultaneously to move the second section of the lever with respect to the first section thereof thereby to adjust the lever to obtain proper control over opening of the choke valve.

9. The improvement as set forth in claim 1 wherein a gage having an index mark thereon is used in adjusting the lever and the front face of the housing has an index mark thereon with which the index mark on the gage is aligned. the index mark on the front face of the housing being covered when the cover is installed on the housing whereby no visible alignment marks are viewable after assembly of the carburetor thus to prevent someone from changing the adjustment of the lever and operation of the choke valve.

10. The improvement as set forth in claim 9 wherein the cover is attached to the housing by rivets or the like thus to prevent someone from removing the cover and changing the adjustment of the lever.

11. The improvement as set forth in claim 1 wherein the link is formed of a hardened metal so the link cannot be bent and the adjustment of the lever effectively altered.

* * * * *